US008453488B2

(12) United States Patent
Xu

(10) Patent No.: US 8,453,488 B2
(45) Date of Patent: Jun. 4, 2013

(54) APPARATUS FOR BENDING RESILIENT TAB

(75) Inventor: Bao-Qin Xu, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 343 days.

(21) Appl. No.: 12/944,741

(22) Filed: Nov. 12, 2010

(65) Prior Publication Data

US 2012/0103053 A1 May 3, 2012

(30) Foreign Application Priority Data

Oct. 28, 2010 (CN) ..... 2010 1 0523207

(51) Int. Cl.
*B21J 13/08* (2006.01)
*B21D 11/10* (2006.01)

(52) U.S. Cl.
USPC ..... 72/458; 72/301; 72/309; 72/450; 72/380

(58) Field of Classification Search
USPC ..... 72/293, 295–297, 300, 301, 302, 72/304, 305, 308, 309, 380, 387, 450, 451, 72/458, 459, 482.6
See application file for complete search history.

(56) References Cited

U.S. PATENT DOCUMENTS 3,121,447 A * 2/1964 Zoschg ..... 72/407
6,295,858 B1 * 10/2001 Torito ..... 72/315

* cited by examiner

*Primary Examiner* — Dana Ross
*Assistant Examiner* — Pradeep C Battula
(74) *Attorney, Agent, or Firm* — Altis Law Group, Inc.

(57) ABSTRACT

An apparatus for bending a resilient tab, includes a chassis to support the tab, a securing element to hold the tab and a sliding element for pressing the tab. The securing element has a clamping portion pressing against a base of the tab and a blocking portion extending towards the sliding element. The sliding element includes a base, a pressing element and a bending element slidably connected to the base. The pressing element is pivotably connected to the bending element. The sliding element can move towards the securing element. As the sliding element moves towards the securing element, the pressing element is pressed by the blocking portion to move relative to the bending element. The bending element is driven by the pressing element to raise and presses the free distal end of the tab at a required angle.

17 Claims, 9 Drawing Sheets

APPARATUS FOR BENDING RESILIENT TAB

BACKGROUND

1. Technical Field

The present disclosure relates to an apparatus, and more particularly, to an apparatus which can conveniently bend a resilient tab to a required angle.

2. Description of Related Art

Resilient tabs are widely used in various industrial applications for their low cost, simple structure and high reliability. In order to produce sufficient flexible force, the resilient tab can be bent to a predetermined angle. The flexible force depends on the angle to be bent, that is to say, the larger the angle that is bent, a larger flexible force needs to be generated. When done manually the bent angle of the resilient tab is difficult to control, thus resulting in low accuracy of bend in the resilient tab.

What is needed, therefore, is an apparatus which can overcome the limitations described above.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
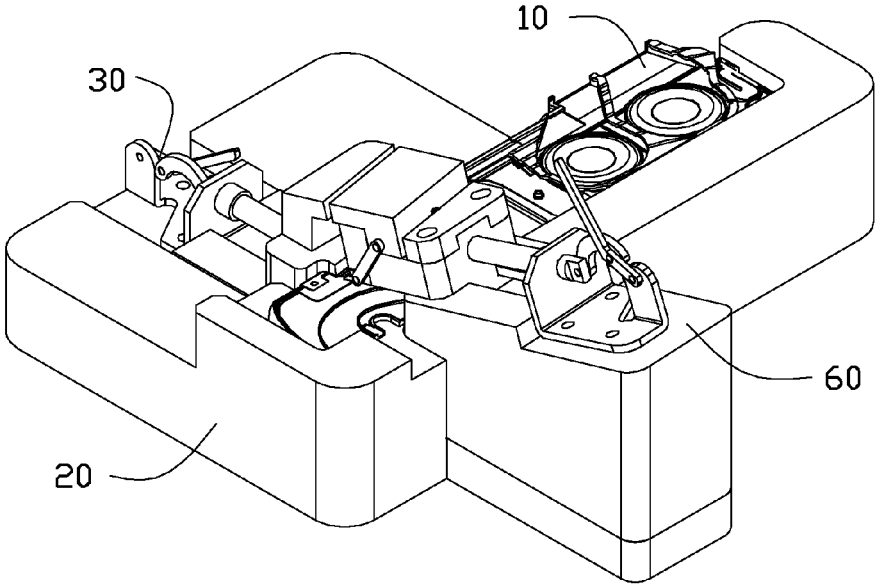
FIG. 1 is an isometric view of an apparatus of the present disclosure, wherein a plate having a resilient tab is disposed in the apparatus.
Figure 2:
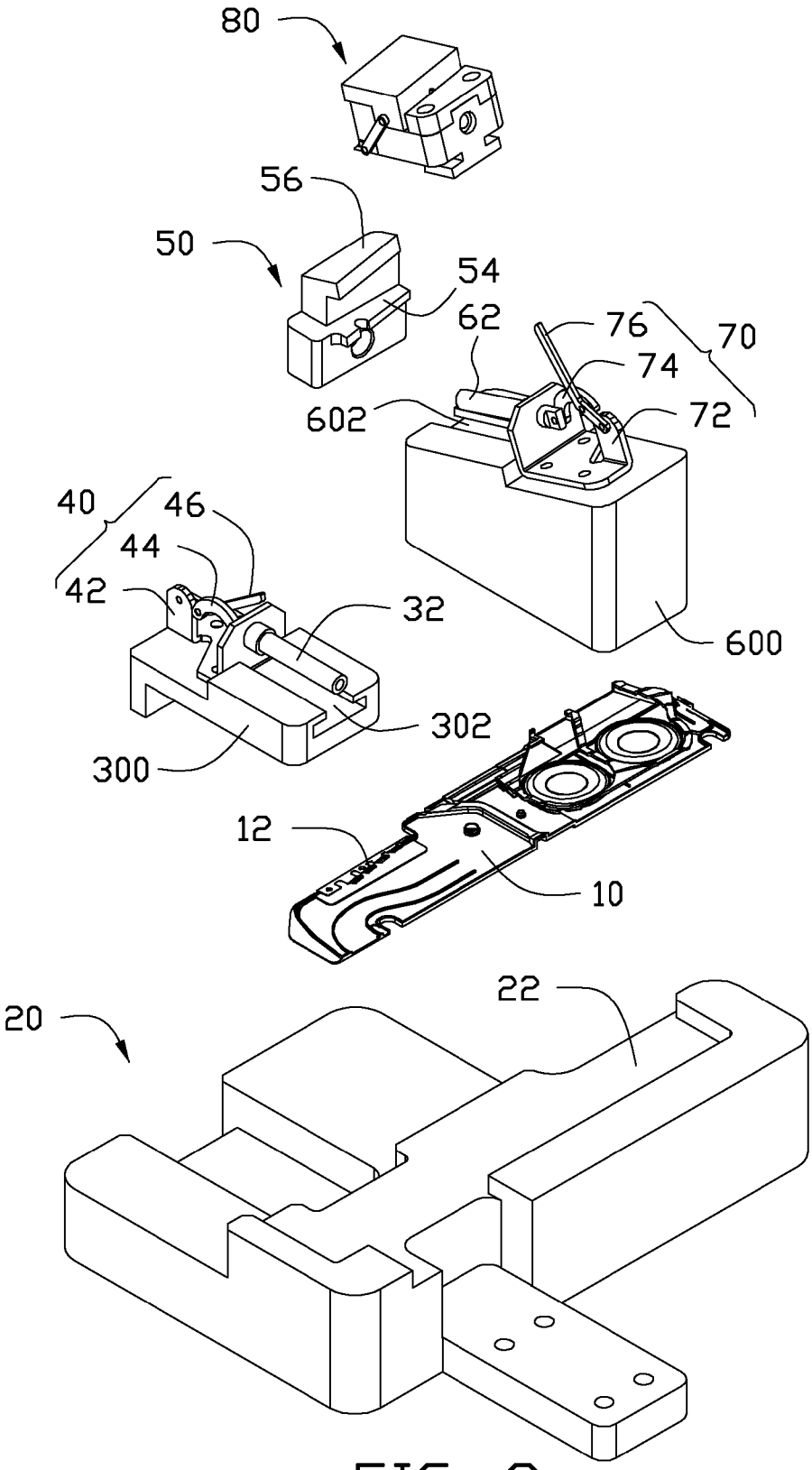
FIG. 2 is an exploded view of the apparatus of FIG. 1.

Referring to FIGS. 1-2, an apparatus of the present disclosure is disclosed. The apparatus bends a resilient tab 12 to a desired angle. The apparatus includes a chassis 20 and a fixing device 30 and an operating device 60 mounted on two opposite sides of the chassis 20. The chassis 20 defines a depression 22 on a top portion thereof for receiving a plate 10 where the resilient tab 12 is mounted.

Figure 3:
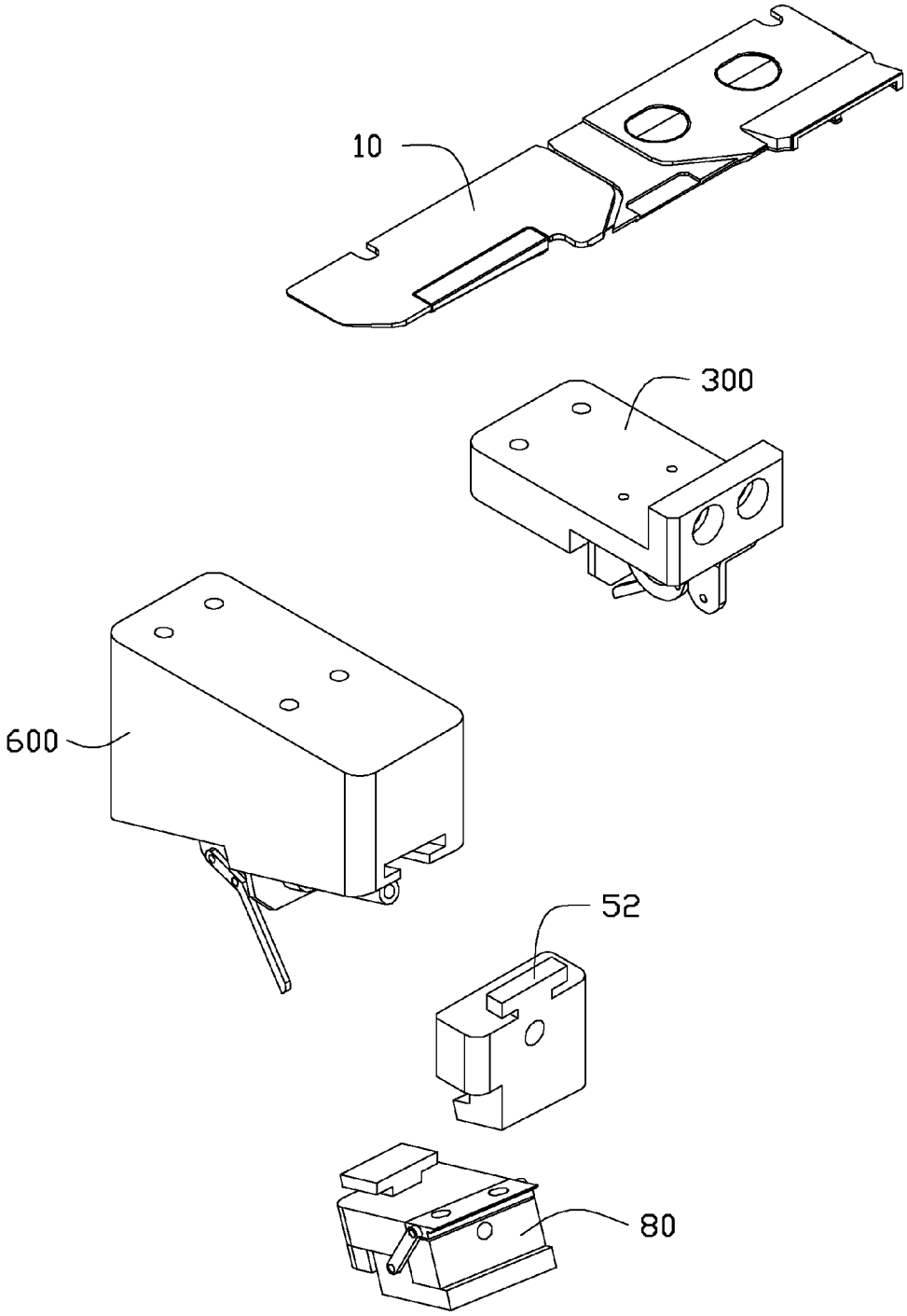
FIG. 3 is an inverted view of the apparatus of FIG. 2, wherein a chassis of the apparatus is removed.

Also referring to FIG. 3, the fixing device 30 includes a carriage 300, a drive element 40 mounted on the carriage 300, a securing element 50 and a shaft 32 connecting the drive element 40 and the securing element 50. The carriage 300 is fixedly retained within the chassis 20. The carriage 300 defines a slot 302 in a top portion thereof for accommodating a part of the securing element 50 therein. The drive element 40 includes a bracket 42 secured on the carriage 300, a handling arm 46 pivotably attached on the bracket 42 and a beam 44 pivotably connecting the handling arm 46 with the shaft 32.

The bracket 42 has two upright flanges (not labeled) perpendicular to each other and a horizontal flange (not labeled) interconnecting the upright flanges and secured on the carriage 300. The handling arm 46 is pivotably coupled to one of the upright flanges of the bracket 42. The shaft 32 is extended through the other upright flange of the bracket 42. The beam 44 is substantially arch shaped and has two opposite ends respectively connected to the handling arm 46 and the shaft 32, the shaft 32 is movable along a horizontal direction by force of the handling arm 46. The securing element 50 has a T-shaped portion 52 protruding downward from a bottom thereof (see FIG. 3), a clamping portion 54 extending horizontally from a middle thereof and a blocking portion 56 extending slantwise from a top thereof along a first direction. The T-shaped portion 52 has a large lower portion and a small upper portion. The T-shaped portion 52 is received in the slot 302 in the carriage 300 for confining the securing element 50 to slide along the slot 302. The clamping portion 54 presses downward against a base end of the resilient tab 12 for preventing the base end of the resilient tab 12 from moving. The blocking portion 56 is oriented upward and inclined towards the operating device 60. The shaft 32 is inserted into the securing element 50 for driving the securing element 50 to move with the pivoting of the handling arm 46.

The operating device 60 includes a carriage 600, a drive element 70 mounted on the carriage 600, a sliding element 80 and a shaft 62 coupling the drive element 70 with the sliding element 80. The carriage 600 is contained within the chassis 20 for positioning the operating device 60 opposite to the fixing device 30. The carriage 600 of the operating device 60 is higher than that of the fixing device 30. The carriage 600 of the operating device 60 has a top portion inclined and gradually ascending away from the fixing device 30 along a first direction. The drive element 70 of the operating device 60 has the same structure as that of the fixing device 30, also including a bracket 72 mounted on the carriage 600, a handling arm 76 pivotably attached on the bracket 72 and a beam 74 connecting the handling arm 76 to the shaft 62. The shaft 62 can be driven by rotation of the handling arm 76 to move along the first direction.

Figure 4:
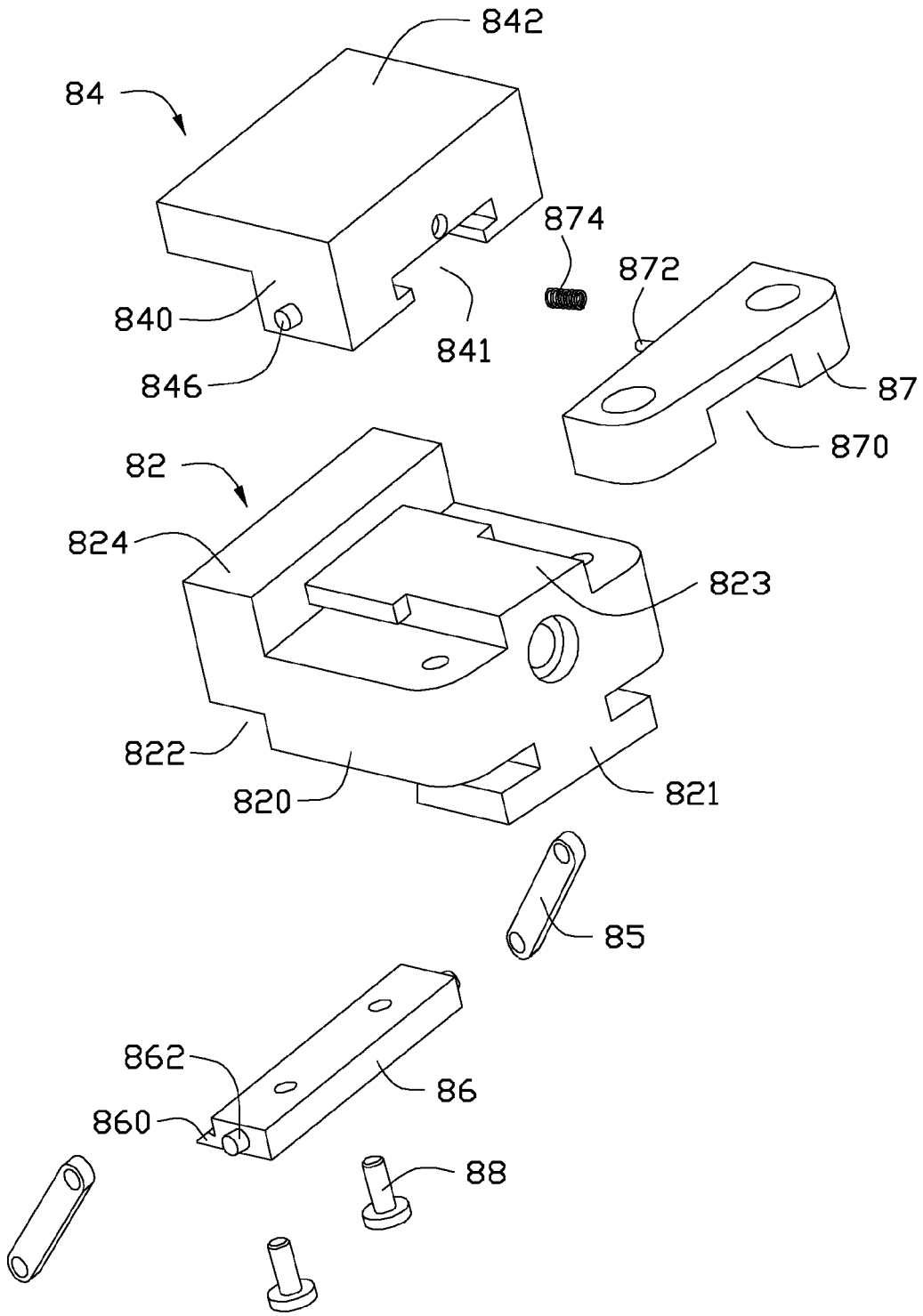
FIG. 4 shows an enlarged and exploded view of the slide element of the apparatus of FIG. 2.
Figure 5:
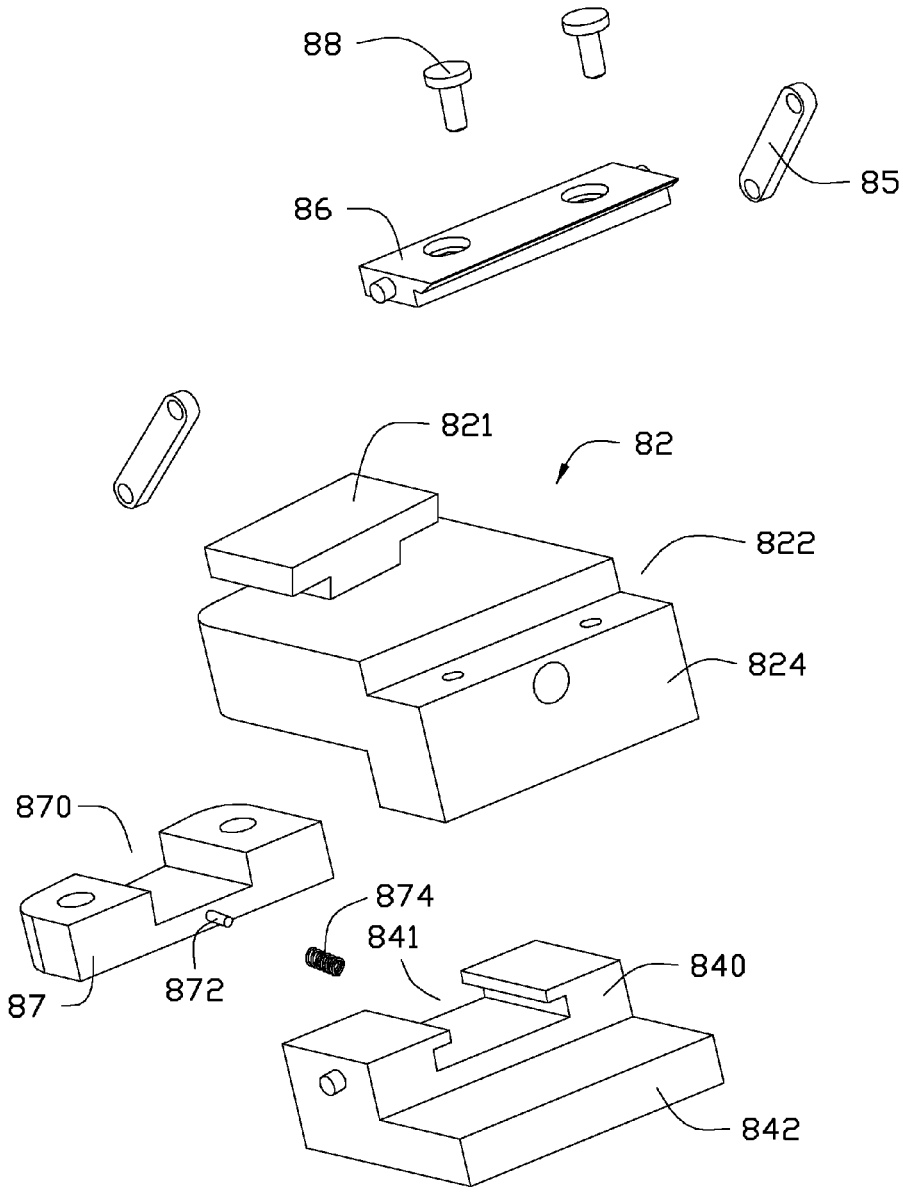
FIG. 5 is an inverted view of the slide element of the apparatus of FIG. 4.
Figure 6:
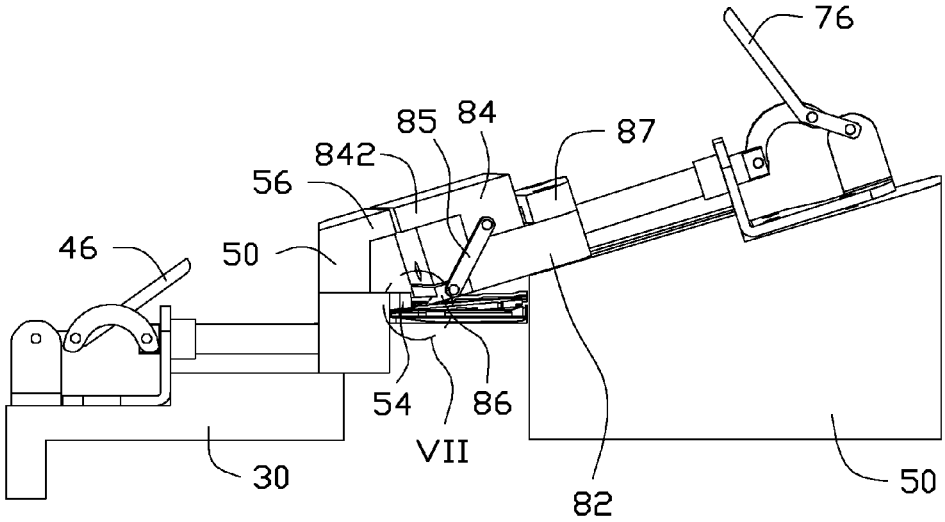
FIG. 6 shows a front view of the apparatus of FIG. 1 with the chassis removed for clarity, wherein the resilient tab is ready for bending.
Figure 7:
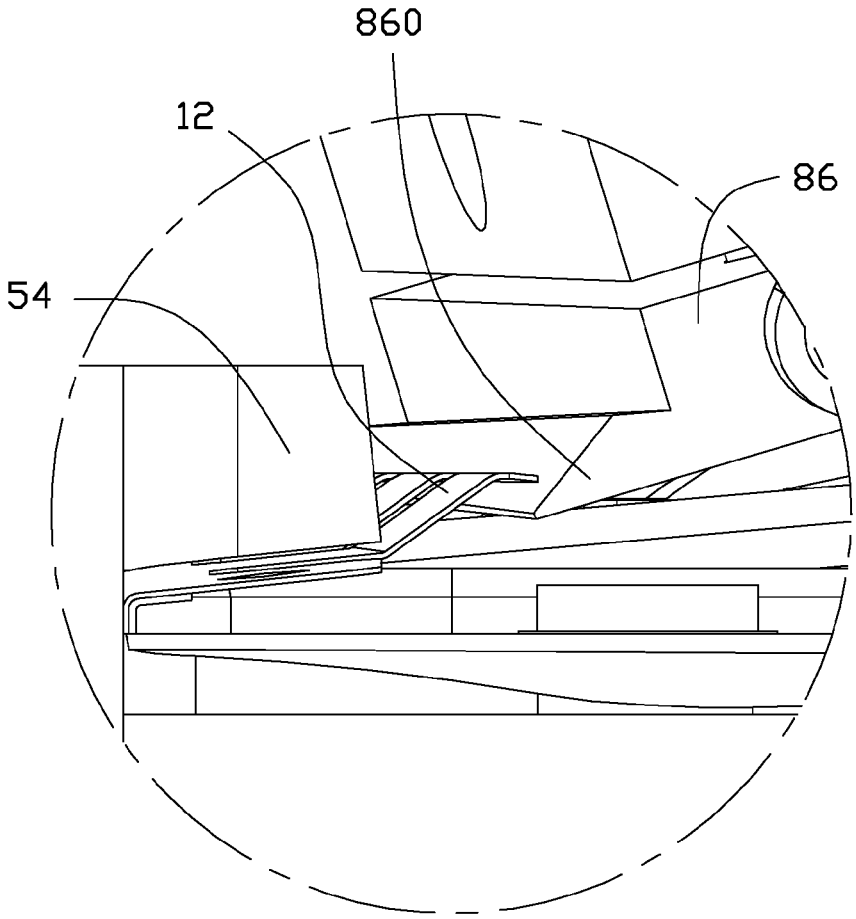
FIG. 7 shows an enlarged part VII of FIG. 6.
Figure 8:
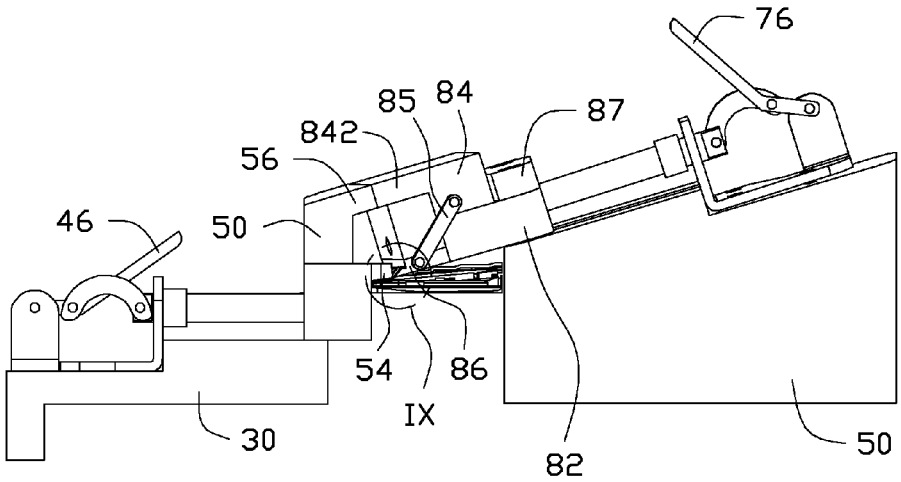
FIG. 8 is similar to FIG. 6, wherein the resilient tab is bent by the apparatus.
Figure 9:
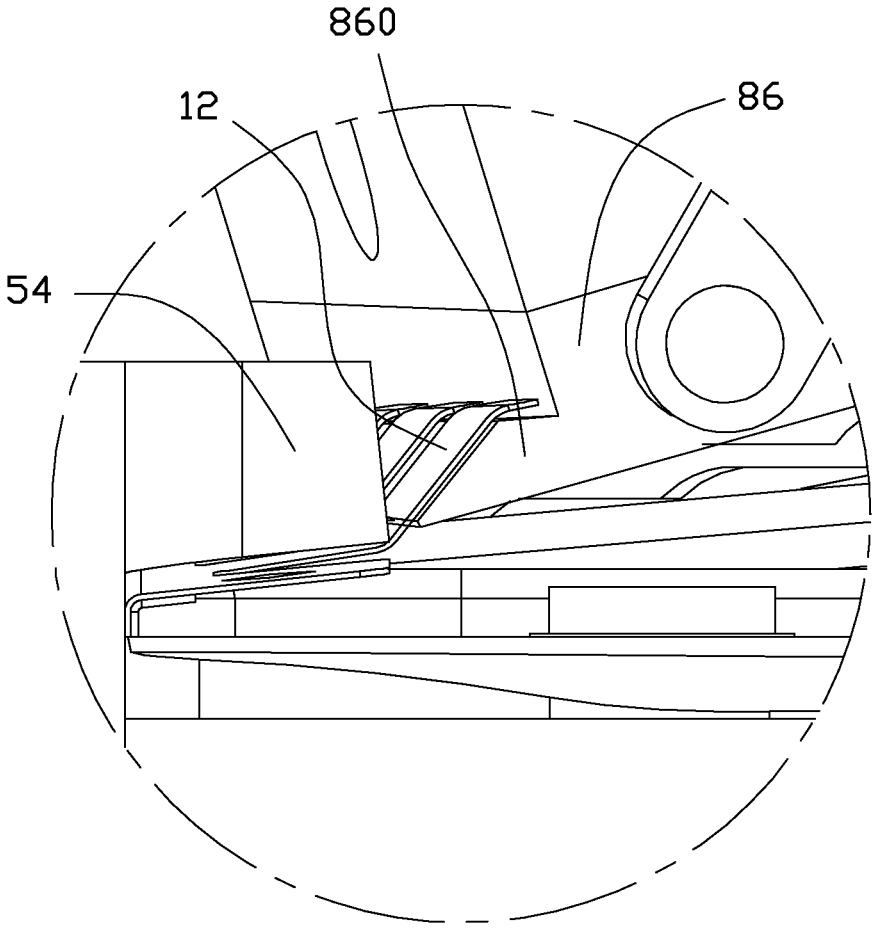
FIG. 9 shows an enlarged part IX of FIG. 8.

Also referring to FIGS. 4-5, the sliding element 80 includes a base 82, a pressing element 84 and a bending element 86 slidably mounted on the base 82 and a retainer 87 fixed on the base 82. The base 82 has a holding portion 820, a T-shaped portion 821 extending downward from a bottom of the holding portion 820 and a block 824 and a rail 823 extending upward from a top of the holding portion 820. The shaft 62 is inserted into the holding portion 820 to drive the sliding element 80 to slide. The holding portion 820 defines a receiving space 822 in a corner between the bottom and a side thereof, for receiving the bending element 86 therein. The T-shaped portion 821 is received in a slot 602 defined in the top of the carriage 600 for confining the sliding element 80 to slide on the carriage 600 along the first direction. The block 824 is located corresponding to the receiving space 822. The rail 823 is perpendicular to the block 824 and has a height less than that of the block 824. The retainer 87 is fixed on the top of the holding portion 820 and has a groove 870 that receives a part of the rail 823 therein. The retainer 87 has a rod 872 protruding towards the pressing element 84 with a spring 874 encircling the rod 872. The pressing element 84 includes a support portion 840 and a pressing portion 842 extending from the support portion 840 towards the fixing device 30. The support portion 840 defines a slot 841 in a bottom thereof to receive the rail 823 so that the support portion 840 can slide on the holding portion 820 along the rail 823. A pair of axles 846 is formed from two opposite sides of the support portion 840. The rod 872 on the retainer 72 has an end inserted into the support portion 840 to compress the spring 874 therebetween. The support portion 840 is located between the block 824 and the retainer 87, being prevented from sliding out of the base 82. The pressing portion 842 is extended beyond the block 824 to protrude towards the blocking portion 56 of the securing element 50. The pressing portion 842 can press against the blocking portion 56 of the securing element 50 to be forced to stop moving. The bending element 86 has a flange 860 extending towards the fixing device 30 and a pair of axles 862 protruding from two opposite ends of the bending element 86. The flange 860 has an inclined surface for pressing a free distal end of the resilient tab 12. A pair of fasteners 88, extend through the bending element 86 into the holding portion 820 to allow the bending element 86 to move in the receiving space 822 along a second direction perpendicular to the first direction. A pair of connection rods 85 with each having two opposite ends engaged with two corresponding axles 846, 862 of the pressing element 84 and the bending element 86, to pivotably connect the bending element 86 to the pressing element 84. The bending element 86 is movable along the second direction by force of the pressing element 84 along the first direction.

Also referring to FIGS. 6-9, when a resilient tab 12 is required to be bent, a plate 10 containing the resilient tab 12 is first disposed in the depression 22 of the chassis 20. Then the handling arm 46 of the fixing device 30 is operated clockwise to push the securing element 50 to move towards the resilient tab 12, until the clamping portion 54 of the securing element 50 presses the base of the resilient tab 12. The handling arm 76 of the operating device 60 is then rotated anticlockwise to push the sliding element 80 to move towards the securing element 50. After the pressing portion 842 of the pressing element 84 abuts against the blocking portion 56 of the securing element 50, the handling arm 76 of the operating device 60 is continuously rotated anticlockwise to push the base 82 to move towards the securing element 50. The pressing portion 842 of the pressing element 84 is confined by the blocking portion 56 of the securing element 50 and thus does not move following the movement of the base 82. At the same time, the bending element 86 keeps moving by force of the base 82. Thus, the pressing element 84 has a first-directional movement relative to the bending element 86. The bending element 86 is raised along the second direction by the toggle levers 85 due to the relative movement, and the flange 860 of the bending element 86 simultaneously presses the free distal end of the resilient tab 12 upward to bend the resilient tab 12 within a desired angle. After bending of the resilient tab 12, the handling arm 76 of the operating device 60 is rotated clockwise to pull the sliding element 80 away from the securing element 50, and the handling arm 46 of the fixing device 30 is rotated anticlockwise to release the bent resilient tab 12. Then the plate 10 with the bent resilient tab 12 can be removed from the depression 22 of the chassis 20. During clockwise rotation of the handling arm 76 of the operating device 60, the spring 874, which has been compressed between the pressing element 84 and the retainer 87 due to relative movement between the pressing element 84 and the retainer 87, is released to push the pressing element 84 towards the block 824 until the pressing element 84 abuts once again against the block 824. Therefore, the apparatus is restored to its original status.

It is believed that the present disclosure and its advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. An apparatus for bending a resilient tab, comprising:
a chassis for supporting the resilient tab;
a securing element for fixing a base end of the resilient tab; and
a sliding element for bending a free distal end of the resilient tab, the sliding element being movable relative to the securing element, the sliding element comprising:
a base;
a pressing element attached to the base, the pressing being movable relative to the base along a first direction, and the first direction being inclined to a horizontal direction; and
a bending element attached to the base, the bending element being movable relative to the base along a second direction;
wherein the bending element is pivotably connected to the pressing element; and
wherein as the sliding element move towards the securing element, the pressing element is pressed by the securing element to move relative to the bending element and drives the bending element to raise, for bending the free distal end of the resilient tab upwardly.

2. The apparatus as claimed in claim 1, wherein the first direction is perpendicular to the second direction.

3. The apparatus as claimed in claim 1, wherein the sliding element further comprises a retainer fixed on the base, the pressing element being resiliently connected to the retainer.

4. The apparatus as claimed in claim 3, wherein the retainer has a rod extending into the pressing element and a spring encircling the rod.

5. The apparatus as claimed in claim 3, wherein the base has a block extending upwardly, the pressing element being slidable between the block and the retainer.

6. The apparatus as claimed in claim 5, wherein the pressing element comprises a supporting portion slidably connected to the base, and a pressing portion extending beyond the block towards the securing element.

7. The apparatus as claimed in claim 1, wherein the base defines a receiving space at a corner thereof, the bending element being received in the receiving space.

8. The apparatus as claimed in claim 7, wherein the sliding element further comprises a fastener extending through the bending element into the base.

9. The apparatus as claimed in claim 1, wherein the pressing element is located at a top of the base, and the bending element is located at a bottom of the base.

10. The apparatus as claimed in claim 1, wherein the pressing element is pivotably connected to the bending element by a toggle lever.

11. The apparatus as claimed in claim 1, wherein the bending element has a flange protruding towards the securing element, the flange having an inclined surface for pressing the free distal end of the resilient tab.

12. The apparatus as claimed in claim 1, wherein the securing element comprises a clamping portion extending horizontally for pressing against the base end of the resilient tab.

13. The apparatus as claimed in claim 12, wherein the securing element comprises a blocking portion extending towards the sliding element along the first direction, the blocking portion being for pressing against the pressing element.

14. The apparatus as claimed in claim 13, wherein the blocking portion is located higher than the clamping portion.

15. The apparatus as claimed in claim 1, wherein the securing element is slidable with respect to the chassis along a horizontal direction.

16. The apparatus as claimed in claim 1, wherein the sliding element is slidable with respect to the chassis along the first direction.

17. The apparatus as claimed in claim 1, wherein each of the sliding element and the securing element is connected to a handling arm by a shaft.

* * * * *